US006902174B2

(12) United States Patent
Hernandez et al.

(10) Patent No.: US 6,902,174 B2
(45) Date of Patent: Jun. 7, 2005

(54) CREEPER WITH TOOL CASE AND MERCHANDISING METHOD

(75) Inventors: Hector Ray Hernandez, Fullerton, CA (US); Chin-Kun Cheng, Taichung (TW)

(73) Assignee: Alltrade Tools LLC, Long Beach, CA (US)

( * ) Notice: Subject to any disclaimer, the term of this patent is extended or adjusted under 35 U.S.C. 154(b) by 0 days.

(21) Appl. No.: 10/284,749

(22) Filed: Oct. 31, 2002

(65) Prior Publication Data

US 2003/0132589 A1 Jul. 17, 2003

Related U.S. Application Data

(60) Provisional application No. 60/347,644, filed on Jan. 11, 2002.

(51) Int. Cl.[7] ..... B25H 5/00
(52) U.S. Cl. ..... 280/32.6; 280/79.2
(58) Field of Search ..... 280/32.6, 87.021, 280/79.11, 79.2, 28.12

(56) References Cited

U.S. PATENT DOCUMENTS

| | | | | | |
|---|---|---|---|---|---|
| 2,069,476 | A | * | 2/1937 | Keil | 280/32.5 |
| 4,721,316 | A | * | 1/1988 | Whiteside | 280/32.6 |
| 4,795,180 | A | * | 1/1989 | Polcyn | 280/79.11 |
| D330,639 | S | * | 11/1992 | Munro et al. | D6/335 |
| D330,957 | S | * | 11/1992 | Contrini | D34/23 |
| 5,330,211 | A | * | 7/1994 | Nicholson | 280/32.6 |
| D354,599 | S | * | 1/1995 | Young | D34/23 |
| 5,494,305 | A | * | 2/1996 | Chen | 280/32.6 |
| 5,524,915 | A | * | 6/1996 | Liu | 280/30 |
| 5,527,051 | A | * | 6/1996 | Plaza | 280/32.6 |
| 5,624,126 | A | * | 4/1997 | Vosbikian et al. | 280/32.6 |
| 5,779,252 | A | * | 7/1998 | Bolton, Jr. | 280/47.371 |
| 6,079,720 | A | * | 6/2000 | Spear et al. | 280/47.371 |
| 6,345,828 | B1 | * | 2/2002 | Pool et al. | 280/32.6 |
| 6,520,513 | B2 | * | 2/2003 | Presley-Mays | 280/32.5 |

* cited by examiner

*Primary Examiner*—Christopher P. Ellis
*Assistant Examiner*—Jeff Restifo
(74) *Attorney, Agent, or Firm*—John J. Connors; Connors & Assoc. Inc.

(57) ABSTRACT

A creeper adapted to store tools in a compartment.

9 Claims, 5 Drawing Sheets

CREEPER WITH TOOL CASE AND MERCHANDISING METHOD

RELATED PATENT APPLICATION & INCORPORATION BY REFERENCE

This application is a utility application based on U.S. provisional patent application Ser. No. 60/347,644 entitled "Molded Creeper with Tools," filed Jan. 11, 2002. This related application is incorporated herein by reference and made a part of this application. If any conflict arises between the disclosure of the invention in this utility application and that in the related provisional application, the disclosure in this utility application shall govern. Moreover, Applicants incorporate herein by reference any and all U.S. patents, U.S. patent applications, and other documents cited or referred to in this application or cited or referred to in the U.S. patents and U.S. patent applications incorporated herein by reference.

DEFINITIONS

The words "comprising," "having," and "including," and other forms thereof, are intended to be equivalent in meaning and be open ended in that an item or items following any one of these words is not meant to be an exhaustive listing of such item or items, or meant to be limited to only the listed item or items.

BACKGROUND OF INVENTION

A mechanic is often required to work with tools on the underside of an automobile or other vehicle to perform maintenance. It has been known to use devices called creepers that include a deck mounted on wheels. A creeper enables the mechanic to move and work underneath an automobile while lying in a supine position on the creeper.

SUMMARY OF INVENTION

This invention, with its several desirable features, is summarized in the CLAIMS that follow. After reading the following section entitled "DETAILED DESCRIPTION," one will understand how the features of this invention provide its benefits. These benefits include, but are not limited to: providing a convenient way to store tools in a creeper, easy access to tools while using a creeper, a more comfortable surface on which to lie while using a creeper, and an improved method of merchandising tools and creepers at a point of sale.

Some, but not all, of the features of this invention are:

One, the creeper includes a compartment adapted to hold tools. The creeper may be sold with the tools stored in the compartment as a single unit at a point-of-sale. Alternately, the creeper and the tools may be sold separately, or both separated but contained within the same packaging. Typically, the creeper is substantially longer than wide, having corners with one wheel at or near each corner. The wheels may be mounted to swivel.

Two, the creeper includes a deck comprising a topside and an underside. The wheels extend outward from the underside and elevate the deck above ground level substantially horizontally a predetermined distance, typically from about 2 to about 5 inches. The compartment may be beneath the underside. The compartment may have an interior adapted to hold tools either in (1) predetermined locations or (2) loosely or (3) both ways. This compartment may be formed by sidewalls and a bottom wall. In one embodiment, the compartment has an opening in the topside to provide access to any tool in the interior.

Three, in one embodiment, the opening is covered with a lid that is moveable between an open position and a closed position. The lid may be detachably mounted to the deck, or it may be mounted to the deck by a hinge member. In this one embodiment, an external side of the lid lies substantially flush with the topside of the deck when the lid is in the closed position.

Four, in one embodiment, the creeper has a body molded from a plastic material with the deck and compartment being integral. The compartment could, however, be constructed as a separate unit and connected to the deck. When the body is made of plastic material and blow molded, it has a substantial portion that is hollow. This reduces the weight of the creeper and reduces costs of manufacture.

Five, the deck may include reinforcing members. Such reinforcing members may be in the topside or underside or both. Examples of such reinforcing members are a series of parallel wedge elements along an inner sidewall of the compartment, a series of ribs extending lengthwise along the underside, a series of ribs extending crosswise along the underside, a plurality of parallel ridges extending lengthwise along the lid, and a plurality of parallel ridges extending lengthwise along the topside of the deck. These reinforcing members impart structural rigidity to the deck, their use is desirable when the body is blow molded and has a hollow portion.

Six, in one embodiment, the sidewalls of the compartment have a predetermined height that is less than the predetermined distance that the wheels elevate the deck above ground level, so that the bottom wall of the compartment is above ground level. Typically, the deck is sufficiently rigid to carry a load of at least 250 pounds and the compartment's bottom wall is above ground level at least 1 inch when carrying this load.

Seven, the compartment may include a tray section with indentations therein conforming to the shape of individual tools. When the tools are sold with the creeper, the individual tools are seated in these indentations. The compartment may also include a well section suitable for storing loose tools.

Eight, the creeper has a head end and a foot end. In one embodiment, the compartment is closer to the foot end than the head end. There may be a headrest on the topside near the head end of the deck. This headrest may be detachably mounted to the deck or molded into the topside of the deck.

Nine, the topside may have a surface including contours that conform the deck's surface configuration more closely to the back of a user lying with his or her back on the deck. For example, there may be a pair of contours, one contour on each side of the headrest. These contours each have a predetermined outline corresponding to one shoulder of a user lying on his or her back on the topside of the deck with his or her head on the headrest. Moreover, the topside may also have a pair of contours near the foot end, one contour near each opposed side of the deck. These contours each have a predetermined outline corresponding to one leg of a user lying on his or her back on the topside of the deck with his or her head on the headrest.

A method of merchandising tools with a creeper at a point-of-sale is also provided. This method includes (a) providing the creeper with a compartment, and (b) storing tools within the compartment such that the tools and creeper are sold together as a unit at a point-of-sale. In this method, the compartment may include a tray section with indentations therein conforming to the shape of individual tools with the individual tools seated in the indentations.

DESCRIPTION OF DRAWINGS

The preferred embodiments of this invention, illustrating all its features, will now be discussed in detail. These embodiments depict the novel and non-obvious creeper and merchandising method of this invention as shown in the accompanying drawings, which are for illustrative purposes only. These drawings include the following figures (FIGS.), with like numerals indicating like parts.

DETAILED DESCRIPTION

A creeper according to this invention may be assembled from individual plastic or metallic components or it may be made from conventional plastic materials such as, for example, polypropylene using conventional injection or blow molding manufacturing techniques. Blow molding is desirable because of lower tooling costs.

Referring to FIGS. 1–5, in this one illustrative embodiment, the creeper 10 is made using blow molding manufacturing techniques. It comprises a deck 12, wheels 20, and a tool storage compartment 30. The deck 12 has a topside 12*a*, an underside 12*b*, a left side 12*c*, a right side 12*d*, a head end 12*e*, and a foot end 12*f*. The sides 12*c* and 12*d* of the deck 12 are longer than the ends 12*e* and 12*f* of the deck 12, so that the deck has an overall substantially rectangular shape with a width w from about 18 to about 24 inches and a length l from about 34 to about 44 inches. The deck 12 may have one or more handles 14*a*, 14*b*, 14*c*, for example, in the form of elongated, oblong apertures through the deck 12, to allow a user to hold the creeper 10. The handles 14*a* and 14*b* may be located near the left side 12*c* and right side 12*d*, respectively. In the embodiment shown, the handle 14*c* is at the foot end 12*f* of the deck 12. In another embodiment, another handle (not shown) may be located at the head end 12*e* of the deck 12. The creeper 10 may be hung during storage by any of the handles 14*a*, 14*b*, 14*c*.

Figure 6:
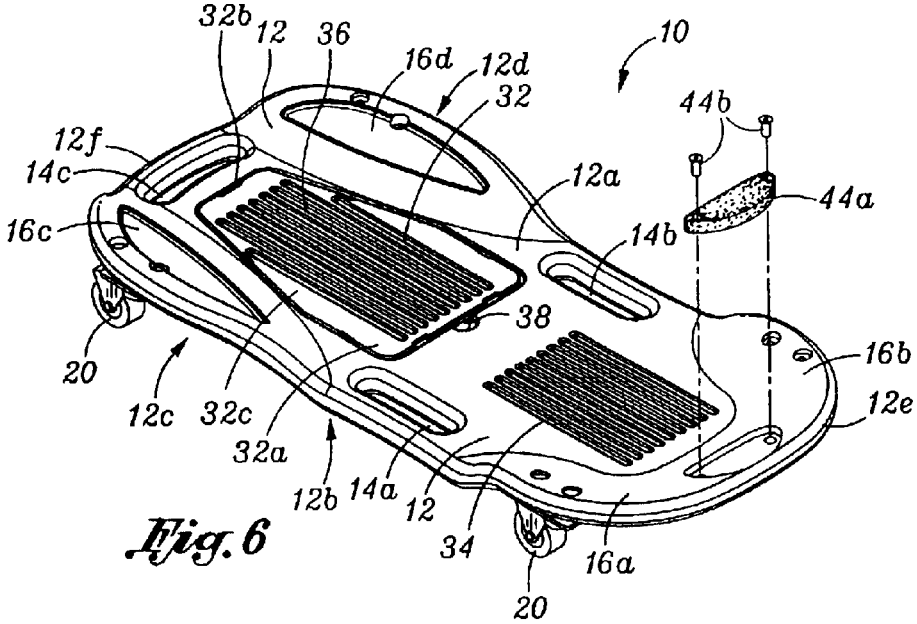
FIG. 6 is a perspective view of a creeper according to an embodiment of the invention employing a detachable headrest.

There is a headrest 44 on the deck. Such a headrest 44 may be molded into the topside 12*a* of the deck 12 as shown best in FIG. 1, permanently affixing it to the topside 12*a*. Or, a headrest 44*a* may be a separate unit that is detachably mounted by screws 44*b* to the deck 12 as shown best in FIG. 6. Typically, the headrest, either headrest 44 or headrest 44*a*, is centrally located on the topside 12*a* near the head end 12*f* along a longitudinal axis X of the creeper 10. The headrest 44 supports the head of a user when the user is lying in a supine position on the deck 12 with his or her head on the headrest and his or her feet near the foot end 12*f*.

In one embodiment, a set of shoulder rests are provided by contours 16*a*, 16*b* and a set of leg rests are provided by contours 16*c*, 16*d*, each set located on the topside 12*a* of the deck 12. The shoulder rests contours 16*a* and 16*b* are located near the head end 12*e* of the deck 12, each near one of the sides 12*c* and 12*d* of the deck 12 on opposite sides of the headrest 44. The outline of the shoulder rests contours 16*a* and 16*b* may each be shaped to correspond to the contour of a user's shoulder when the user is lying on the creeper 10 with his or her head on the headrest 44 as discussed above. The leg rests contours 16*c* and 16*d* may be located near the foot end 12*f* of the deck 12, near the left side 12*c* and the right side 12*d* of the deck 12, respectively. The leg rests contours 16*c* and 16*d* may be shaped to correspond to the back of a user's leg when the user is lying on the creeper 10 with his or her head on the headrest 44 and the user's left leg resting on the contour 16*c* and the user's right leg resting on the contour 16*d*. The shoulder rests contours 16*a*, 16*b* and the leg rests contours 16*c*, 16*d* provide additional comfort to a user because the contours 16*a*, 16*b*, 16*c* and 16*b* provide a wider support area conforming to the shape of the portion of the user's body, i.e. shoulders and legs, in contact with the topside 12*a* as compared to a non-contoured surface. The contours 16*a*, 16*b*, 16*c* and 16*b* are typically formed from plastic material that is molded to provide the desired shape of the contour.

In one embodiment, the compartment 30 may be a separate unit and attached for example by bolts (not shown) to the deck 12. In the embodiments illustrated, the compartment 30 and the deck 12 are integrally molded from the same plastic material. The compartment 30 provides an interior space S (FIGS. 4 and 5) having an opening 30*g* in the topside 12*a* of the deck 12. The interior space S includes a well 42 and a tray section 40, typically recessed below the topside 12*a*. The well 42 has an open mouth M surrounded by a recessed U-shaped rim 35. The tray section 40 includes a recessed, substantially flat, planar ledge 33 having a one or more indentations 40*a* therein. The recessed U-shaped rim 35 and planar ledge 33 are in the same plane and both support a lid 32 seated in the opening 30*g*. The lid 32 has substantially the same configuration as the opening 30*g*. In this embodiment, both are six-sided polygons, with the lid having dimensions essentially the same as those of the opening 30*g* so the lid snaps into position and fits snugly within the opening when it is resting on the rim 35 and ledge 33. When the lid 32 is so seated, its external surface 35*a* is substantially flush with the topside 12*a* of the deck 12. Both the well 42 and the tray section 40 may each be adapted to hold tools.

The well 42 includes a bottom wall 30*a* and four sidewalls 30*b*, 30*d*, 30*e*, 30*f* extending from the bottom wall 30*a* to form the open mouth M of the well. The sidewalls 30*b* and 30*d* of the well 42 may taper outward, and the sidewall 30*e* may taper outward towards the foot end 12*f* of the deck 12. The bottom wall 30*a* forms a portion of the underside 12*b* of the deck 12, extending beyond the well to terminate in an inner compartment sidewall 31 having reinforcing members such as, for example, a series of parallel wedge elements 50 (FIGS. 8 and 9) along this inner sidewall.

Figure 8:
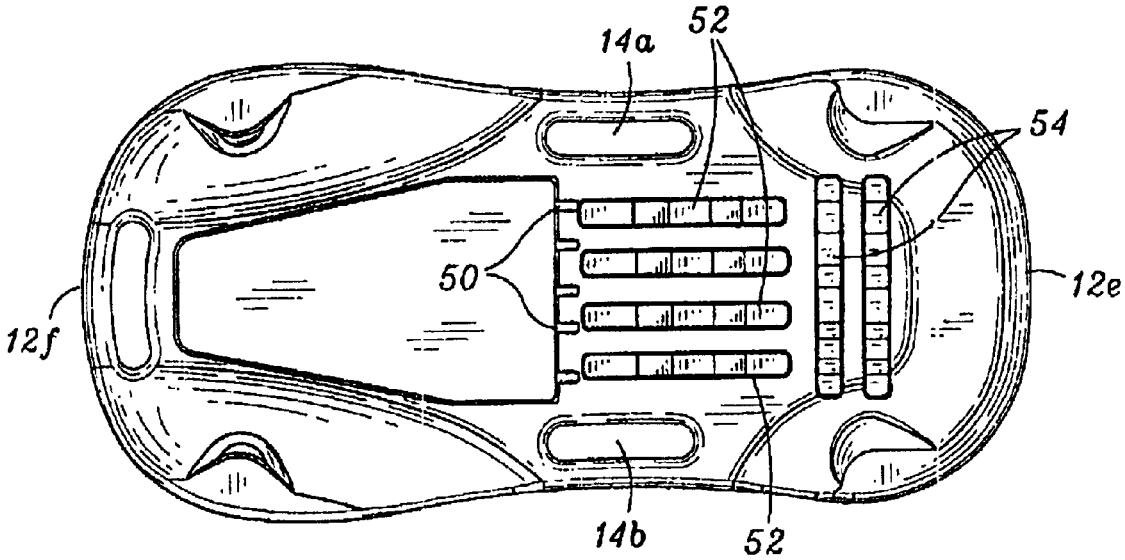
FIG. 8 is a bottom view of the creeper shown in FIG. 1 with the caster wheels removed.
Figure 9:
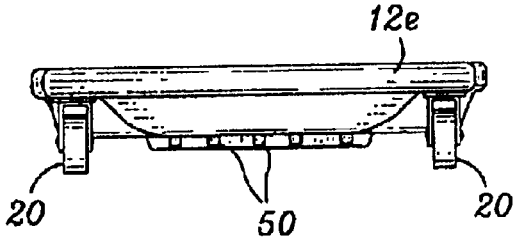
FIG. 9 is an elevational view of the head end of the creeper shown in FIG. 1.

Reinforcing members are most suited for use when the deck 12 is blow molded from plastic. There are additional reinforcing members in the deck 12. As shown in FIG. 8, a series of recessed ribs 52 extend lengthwise along the underside 12*b* and a series of recessed ribs 54 extend crosswise along the underside. In the illustartive embodiment, the topside 12*a* of the creeper 10 has a plurality of ridges 34 therein near the head end 12*e*. These ridges 34 may be shaped to resist movement of a user as he or she lies on the creeper 10, as well as reinforcing the deck's resistance to bending. The ridges 34 extend lengthwise along the topside 12*a* of the deck 12 substantially parallel to the axis X. There may also be ridges 36 in the lid 32 extending lengthwise along the external side 36 of the lid 32 substantially parallel to the axis X. All these reinforcing members impart structural rigidity to the deck 12 or lid 32, is the case may be. The creeper 10 is designed so the bottom wall 30*a* is at least 1 inch from the ground surface when the creeper 10 is being used and typically is parallel to the ground when the creeper 10 is being used. One embodiment of the creeper 10 is designed to carry a load of at least 250 pounds, with the bottom wall 30*a* being at least 1 inch above ground level.

In one embodiment, the ridges 34, 36 may be formed from a soft, deformable material such as rubber, such that the ridges 34, 36 provide resistance to the movement of the user when in a supine position, as well as providing cushioned comfort.

Figure 5:
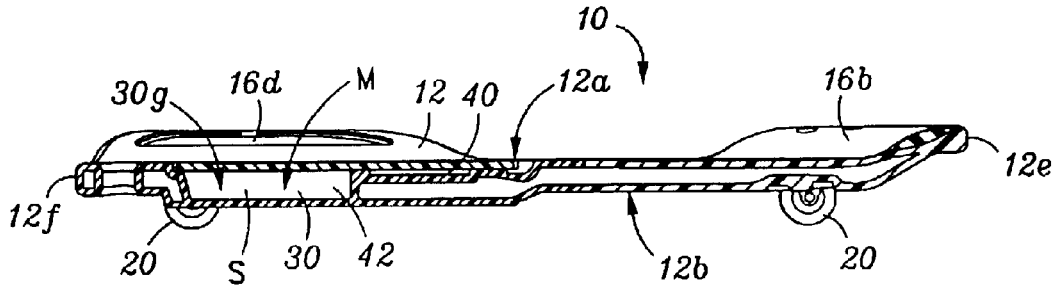
FIG. 5 is a cross-sectional view of the creeper taken along line 5—5 of FIG. 3.
Figure 5A:
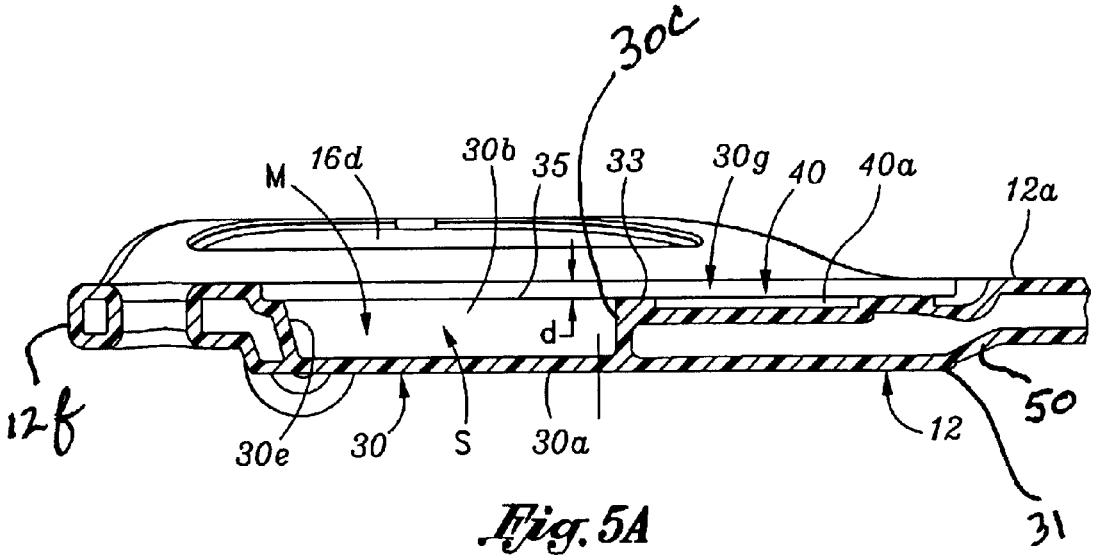
FIG. 5A is a fragmentary, enlarged cross-sectional view of the foot end of the creeper shown in FIG. 1 with the lid removed.

The recessed, planar ledge 33 of the tray section 40 is adjacent the open mouth M and is inward thereto, closer to the user's torso and head end 12*e* than the well 42. The distance d (FIG. 5A) the ledge 33 is from the topside 12*a* is about 1/16 to about 1/4 inch. This ledge 33 is substantially parallel to the topside 12*a*. There may be a plurality of indentations 40*a* in the ledge 33 holding tools. The individual indentations 40*a* are shaped to the outline of the stored tools such that when an individual tool is placed within an indentation 40*a*, the tool is frictionally secure within the indentation 40*a*. The tray section 40 typically is rectangular is shape, although other shapes are acceptable. Typically, the tray section 40 has a surface area of from about 60 to about 80 square inches.

Figure 3:
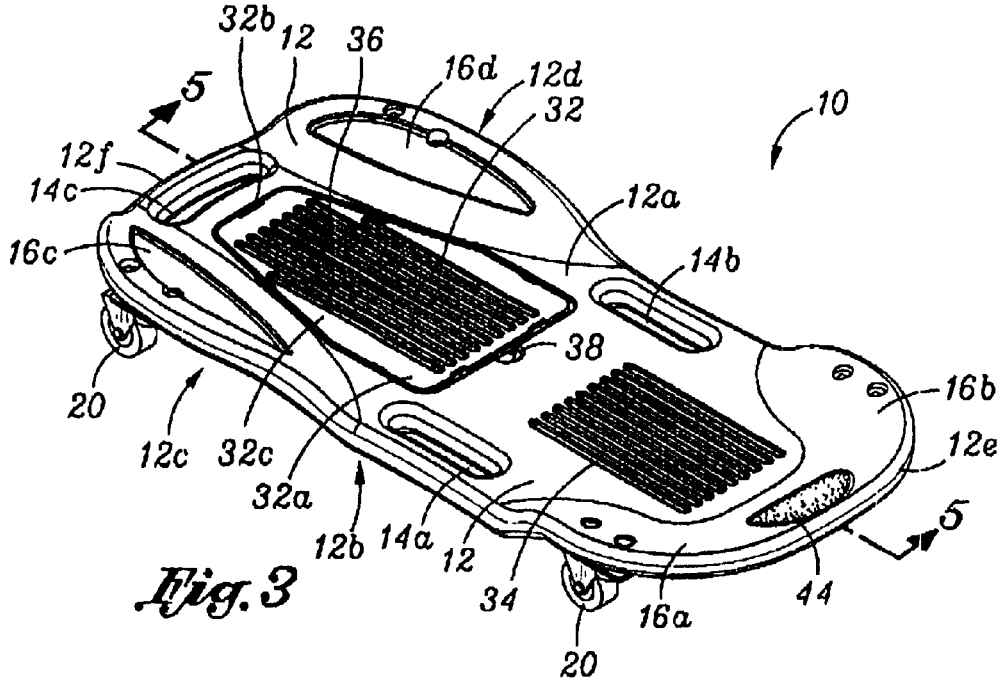
FIG. 3 is a perspective view of a creeper according to the embodiment of the invention shown in FIG. 1.
Figure 4:
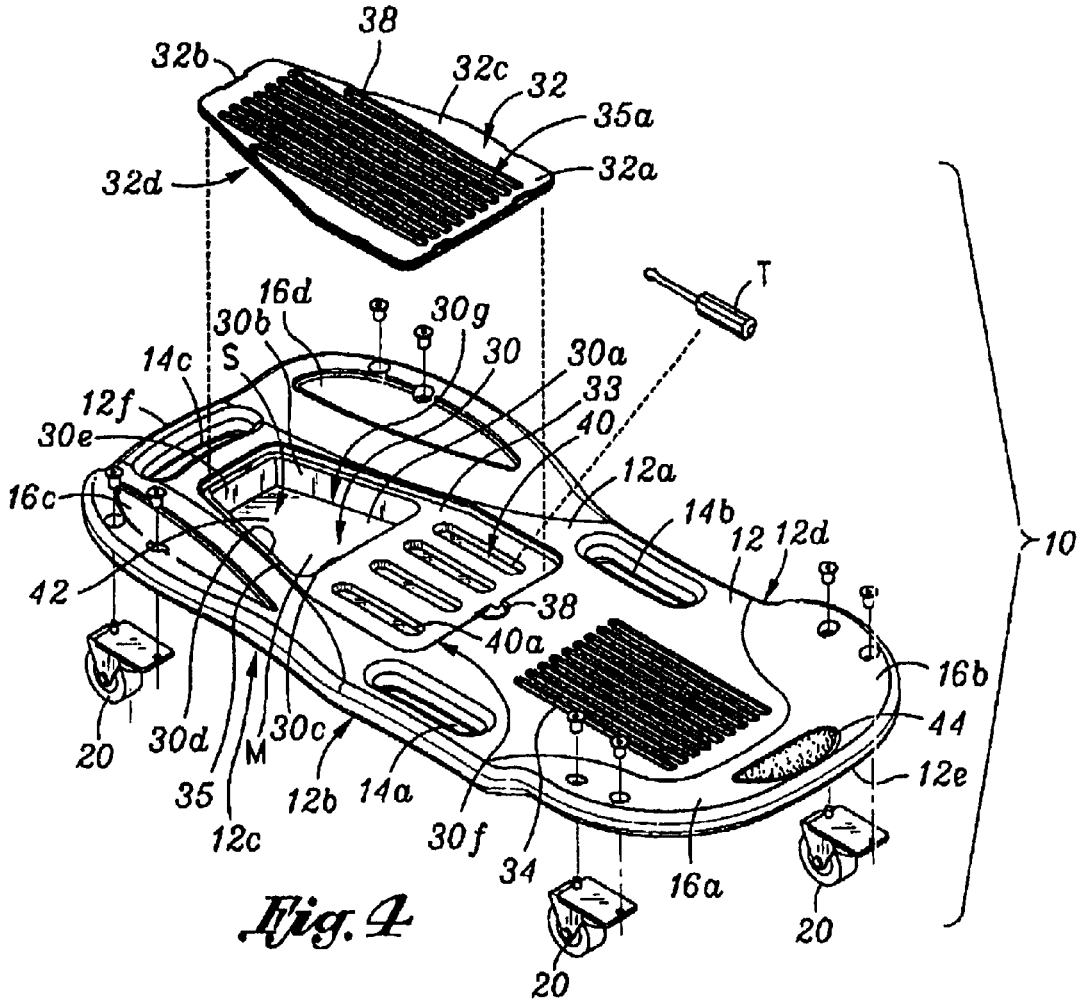
FIG. 4 is a perspective view of a creeper according to the embodiment of the invention shown in FIG. 1 with caster wheels and a hinged lid for a tool compartment exploded.
Figure 7:
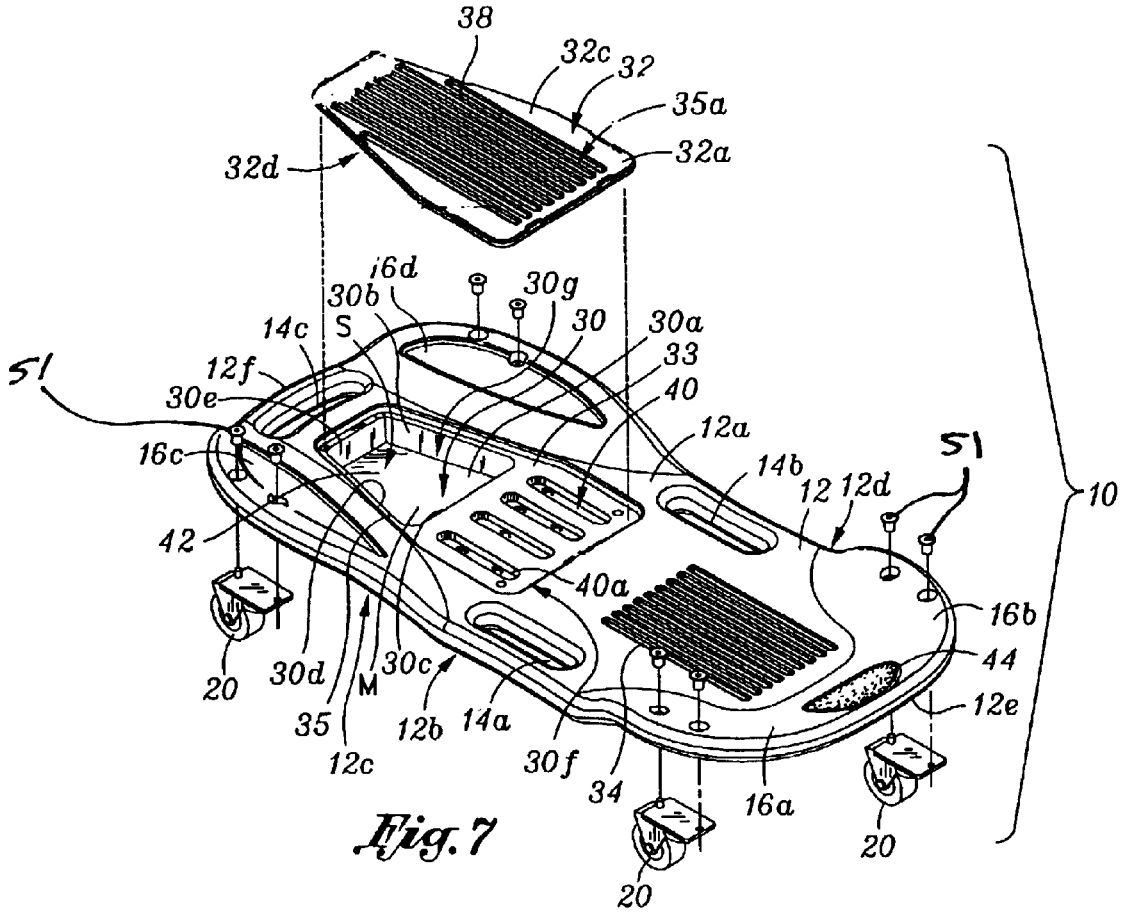
FIG. 7 is a perspective view of a creeper according to an embodiment of the invention employing a detachable lid.

The lid 32 is moveable between an open position and a closed position. In the open position, a user has access to any tools stored on the compartment 30. In the closed position, the lid 32 forms part of the topside 12*a* of the deck. For example: (a) As shown in FIG. 7, the lid 32 snaps into the opening 30*g*. (b) Or, as shown in FIGS. 3 and 4, the lid 32 is coupled at one end by a hinge 32*b* to the deck 12. When in a closed position, an external side 32*c* of the lid 32 lies flush with the topside 12*a* of the deck 12. To open the lid 30 depicted in FIG. 7, the lid popped out by pressing against it. To open the lid 30 depicted in FIGS. 3 and 4, a user inserts his or her hand into a hole 38 next to the lid such that he or she can grasp the lid at an unhinged end 32*a* and pull it open. The hole 38 typically lies adjacent to unhinged end 32*a*. When the lid 32 is opened, the lid 32 rotates about the hinge 32*b*, exposing the interior space S compartment 30. In either embodiment, the compartment 30 may be near the foot end 12*f* of the deck 12 so a user may more easily access the tools stored in the compartment 30.

The creeper 10 may be sold with or without tools, for example, a screwdriver T (only one shown in FIG. 4). When sold with tools, the tools may be stored in the well 42, or in the indentations 40*a* in the tray section 40, or both. The well 42 comprises a zone where loose tools may be stored, such loose tools not being in any fixed location so they are free to move within the well. The volume of this zone is typically from about 120 to about 160 cubic inches. Examples of loose tools are pressure gauges, screwdrivers, and wrenches.

In one embodiment, the tools are sold with the creeper 10, such that, the tools are stored in the tray section 40, and retained within the indentations 40*a* until used. For example, a ratchet set may be packaged and sold with the creeper 10, with the ratchet and bits stored within indentations 40*a*. Loose tools may also be sold with the creeper 10 by simply placing them within the well 42, without any tools being stored within the indentations 40*a*.

Figure 1:
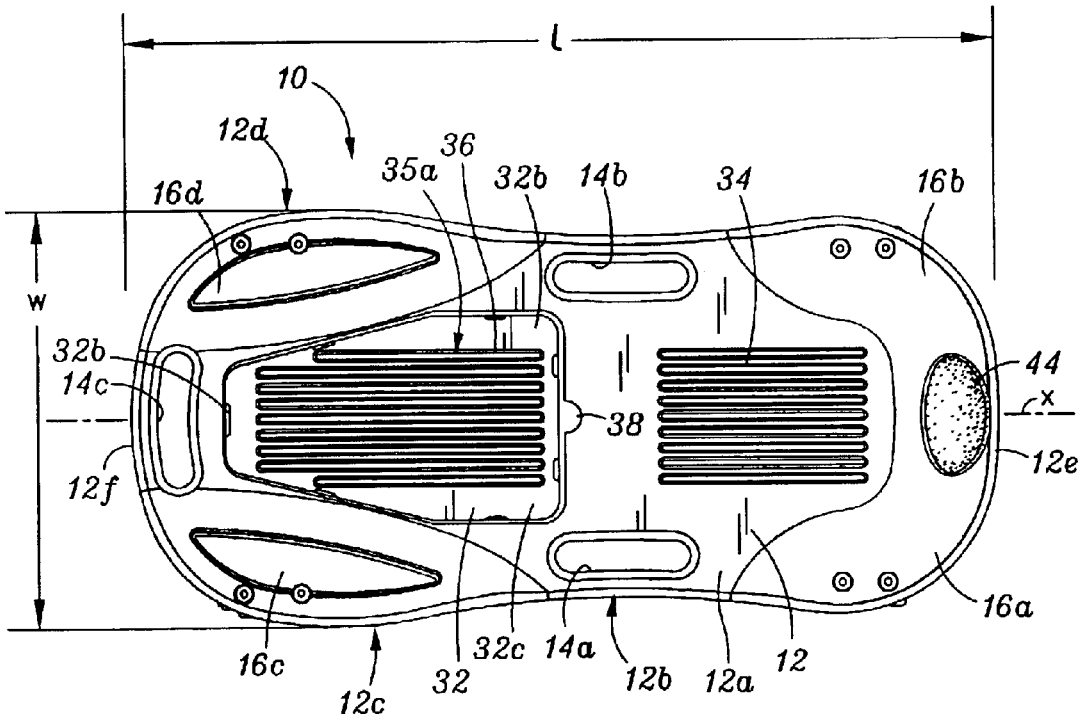
FIG. 1 is a top plan view of a creeper according to one embodiment of the invention.
Figure 2:
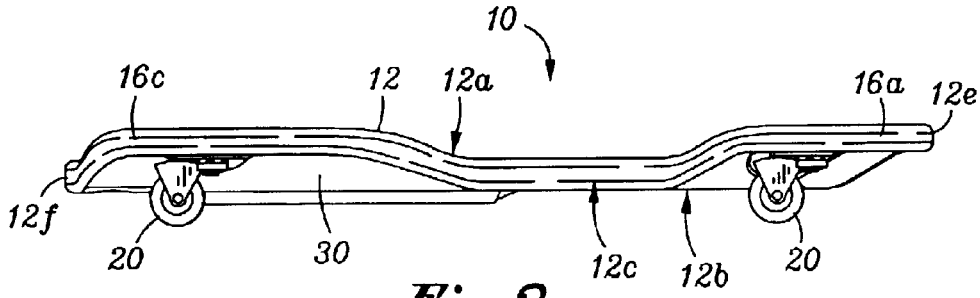
FIG. 2 is a side view of a creeper according to the embodiment of the invention shown in FIG. 1.

Referring to FIGS. 2, 3 and 4, the creeper 10 includes a rolling mechanism, such as wheels 20 attached to the deck 12 by conventional bolt or screw type fasteners 51. These wheels extend outward from the underside 12*b* of the deck 12. In one embodiment, the wheels 20 may be located near opposite ends of sides 12*c* and 12*d*, at or near the corners of the deck 12. Typically, each wheel 20 is a caster type wheel mounted to swivel, allowing the wheel 20 to turn and point in a desired direction when the creeper 10 is in use. The wheels 20 are high enough so that the bottom wall 30*a* of the compartment 30 is above ground when the creeper 10 is being used, elevate the deck above ground level a predetermined distance, typically from about 2 to about 5 inches. The wheels are all the same height, so that the creeper 10 when being used is oriented substantially horizontally.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention:

What is claimed is:

1. A creeper comprising a unitary body molded from a plastic material and comprising a rigid deck having a topside, an underside, a head end, a foot end, and a tool compartment integral with the body that is adapted to store tools, said body being blow molded and including a hollow portion and a plurality of reinforcing members, and wheels extending outward from the underside and attached to the deck that elevate the deck above ground level a predetermined distance and orient said deck substantially parallel to ground level, said compartment being beneath the underside and above ground level when the creeper is being used, and being closer to the foot end than the head end, said topside of the deck having an opening therein that provides access to the compartment.

2. The creeper of claim 1 where tools are stored within said compartment.

3. The creeper of claim 2 where the compartment includes a tray section with indentations therein conforming to the shape of individual tools and said individual tools are seated in said indentations.

4. The creeper of claim 2 where the opening is covered with a lid that is moveable between an open position and a closed position.

5. The creeper of claim 4 where an external side of said lid lies substantially flush with the topside of said deck when said lid is in the closed position.

6. The creeper of claim 5 where the deck includes at least one reinforcing member.

7. The creeper of claim 1 where the deck is sufficiently rigid to carry a load of 250 pounds with said compartment being above ground level at least 1 inch when carrying said load.

8. The creeper of claim 6 where the compartment includes a tray section with indentations therein conforming to the shape of individual tools and said individual tools are seated in said indentations.

9. The creeper of claim 6 where the deck is sufficiently rigid to carry a load of 250 pounds with said compartment being above ground level at least 1 inch when carrying said load.

* * * * *